United States Patent [19]

Hammer et al.

[11] Patent Number: 4,709,872

[45] Date of Patent: Dec. 1, 1987

[54] WEB TENSION CONTROL AND EMERGENCY STOP SYSTEM

[75] Inventors: Josef Hammer, Asbach-Bäumenheim; Walter Handschuher, Königsbrunn, both of Fed. Rep. of Germany

[73] Assignee: M.A.N.-ROLAND Druckmaschinen Aktiengesellschaft, Offenbach am Main, Fed. Rep. of Germany

[21] Appl. No.: 17,758

[22] Filed: Feb. 24, 1987

[30] Foreign Application Priority Data

Mar. 12, 1986 [DE] Fed. Rep. of Germany ..... 3608182

[51] Int. Cl.[4] ..... B65H 26/00

[52] U.S. Cl. ..... 242/75.43

[58] Field of Search ..... 242/75.42, 75.43, 75.44, 242/75.45, 75.46, 75.47; 254/273; 188/83

[56] References Cited

U.S. PATENT DOCUMENTS

| | | | |
|---|---|---|---|
| 686,826 | 11/1901 | Müllers | 188/83 |
| 1,990,643 | 2/1935 | Fankboner | 242/75.42 |
| 3,813,052 | 5/1974 | Swann et al. | 242/75.43 X |
| 3,913,855 | 10/1975 | Heimlicher et al. | 242/75.43 |
| 4,000,865 | 1/1977 | Gaskins | 242/75.43 |
| 4,151,594 | 4/1979 | Stern | 242/75.44 X |

FOREIGN PATENT DOCUMENTS 0013368 7/1980 European Pat. Off. .

3044462 6/1982 Fed. Rep. of Germany .

*Primary Examiner*—Stuart S. Levy
*Assistant Examiner*—Katherine Matecki
*Attorney, Agent, or Firm*—Frishauf, Holtz, Goodman & Woodward

[57] ABSTRACT

To provide for controlled braking effort on a selected paper roll (5) from which a web (14) is applied to a utilization machine, and additionally for fast-stop or holding conditions, the roll is coupled to an operating disk brake (10) which receives braking pressure from a regulated pressure source. Additionally, rapid-stop brake calipers forming a rapid-stop brake (11) are applied to the disk, preferably having a higher braking friction coefficient, and controlled from the regulated pressure via a fluid disjunctive or OR-gate valve (42). A magnetic valve (36), controlled by a computer-controller (28), selectively switches the controlled fluid pressure through the OR-gate valve (42) only to the operating brake or to the fast-stop brake and, via a branch connection (46a), also to the operating brake. Under high emergency conditions, or to hold a roll stopped, for example for roll changing, unregulated pressure can be applied to both the operating brake (10) and the fast-stop brake (11) by a further electromagnetically controlled valve (38) connected through a further OR-gate valve (44) to the second output of the first electromagnetically controlled valve (36).

14 Claims, 2 Drawing Figures

WEB TENSION CONTROL AND EMERGENCY STOP SYSTEM

The present invention relates to web handling apparatus, and more particularly to an apparatus to maintain tension in a paper web being supplied to a printing machine, while providing for stopping of a web supply roll under emergency conditions, for example if a tear in the web should have been sensed.

BACKGROUND

Various types of web controls for unwinding or unreeling apparatus are known in which a brake is provided braking the roll or reel from which the web is unwound, to maintain tension of the web as it is being passed to a web handling machine, typically a rotary web printing machine. Sometimes the web may tear. Printing machines and other web handling machines have sensors which sense the tension of the web as it passes to or through the web handling apparatus typically a printing machine, and, if a tear is sensed, provide an emergency stop signal which is processed to cause the roll to stop unreeling. Paper rolls, for example rolls used to provide newsprints, especially when full, are very heavy and the inertia of the turning roll is considerable.

German Patent No. 30 44 462 discloses an arrangement in which a support frame carries two web rolls. The web rolls are held on roll cores which are coupled to a core brake. In addition to the core brake, further brakes are provided which are controlled if a web tear should be sensed. This requires complex control arrangements and additional brake structures. Yet, it is not possible to obtain fast or emergency stopping of the web under tear or other emergency conditions, with the braking being carried out under controlled braking conditions. The brakes which are used for emergency or fast stopping conditions are electrodynamic brakes. Generators which, under braking conditions operate as dynamic brakes, are effective but do not act rapidly enough for most emergency braking conditions. Thus, the response time of the brakes of the disclosed system is comparatively long, both under normal operating conditions and, especially, under emergency conditions.

European Patent No. 00 13 368 discloses a system to obtain accelerated stopping under emergency conditions which is matched to then pertaining operating conditions. The arrangement, however, requires a complex control circuitry which utilizes a plurality of choking or throttling arrangements. Such choking and throttling arrangements cause damping of the overall system. If the reference values with which the system operates have a tendency to vary, the control loop will be subjected to substantial dead-time intervals, so that the overall reaction of the system is slow.

THE INVENTION

It is an object to improve a tension control system which is combined with an emergency rapid-stop system which is simple, can be readily built with a minimum of components and especially using only well known and readily available rapidly acting components and which is thus highly reliable, and which responds both under normal conditions as well as under emergency stopping conditions at a faster rate than prior art structures. Additionally, the system should be fail-safe so that it will operate even under failure of electrical control signals or electric power. The system, additionally, should be capable of providing a defined stop position, for example to permit operators to change paper reels, without requiring additional structures.

Briefly, the system operates with a controlled pressure fluid, preferably compressed air. An electrically controllable fluid pressure regulator receives pressurized fluid from a source, typically compressed air, and provides controlled pressurized fluid to an electrically controlled magnetic valve. A computer or controller unit controls the pressure of the fluid supplied by the pressure regulator, in accordance with a desired tension setting. The magnetic valve, which receives the controlled fluid pressure, has two pressure fluid outputs. One of the outputs is connected to a fluid disjunctive or OR-gate valve. The OR-gate valve has its output connected to and controls the normally operating brake for the supply roll. The supply roll is coupled, further, to a second brake, which is a fast-acting stop brake, and may be in the form of caliper pads applied to the same brake disk as the operating brake. The stop brake is controlled by a brake fluid connection from the electromagnetic valve, with a branch line to a second input of the fluid disjunctive or OR-gate valve.

Under ordinary operating conditions, the electromagnetic valve supplies fluid through the OR-gate valve to the operating brake in order to retard reeling-off of a web from the roll, and to maintain predetermined tension. Under emergency conditions, however, the electromagnetic valve is controlled from the computer or controller unit to connect the pressure from the fluid pressure regulator to the fast operating stop brake and, in addition, to the second input of the fluid pressure OR-gate so that, at that time, both brakes will become effective.

In accordance with a preferred feature of the invention, the coefficients of friction of the operating brake and the emergency stop brake can be different and, further, unregulated, high-pressure fluid, typically compressed air, can be applied to the emergency stop brake under emergency conditions, under control of the computer or control unit while, simultaneously, providing controlled pressure to the operating brake, so that maximum effective braking pressure can be obtained.

DRAWINGS

FIG. 1 is a schematic illustration of a portion of a web path, and apparatus with which it is associated, to determine web tension, and illustrating the braking arrangement; and FIG. 2 is an electro-pneumatic circuit diagram to illustrate control of tension under normal conditions as well as showing the system and system operation under emergency-stop conditions.

DETAILED DESCRIPTION

Figure 1:
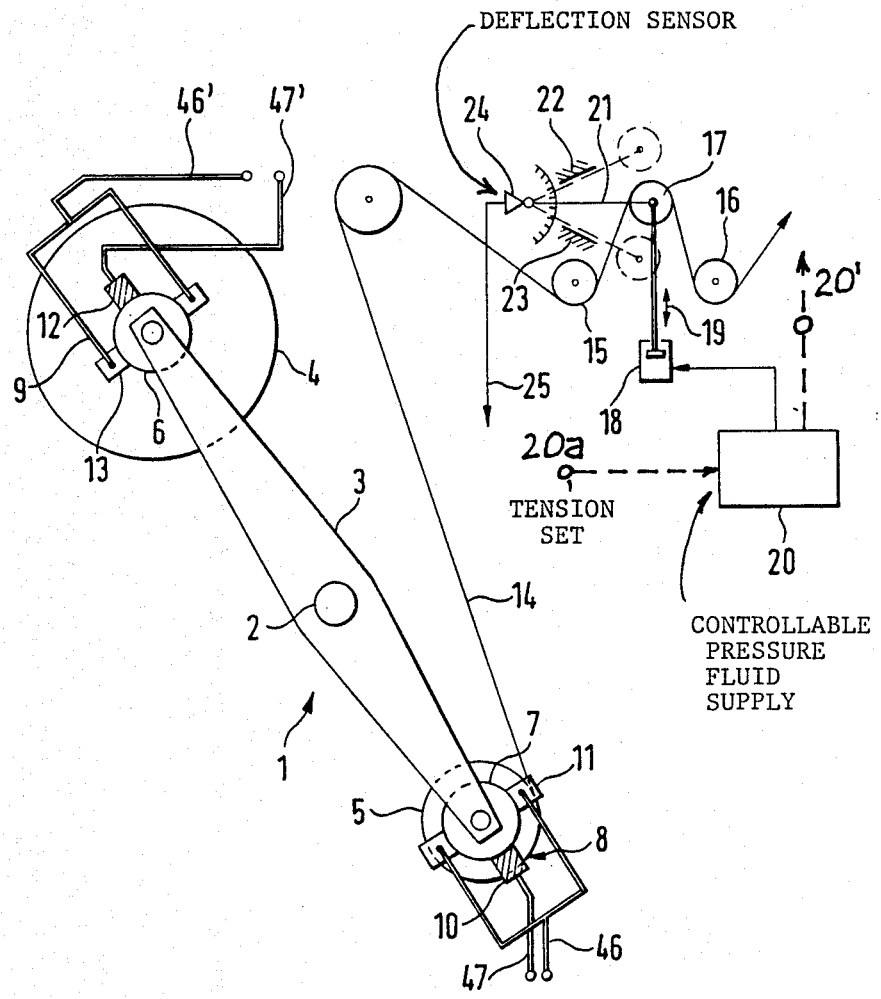

The present invention will be described in connection with a rotary web printing machine, and in connection with paper printing webs. It is, however, also applicable to other types of web unrolling or unreeling apparatus.

In the printing field, it is customary to provide a web roll carrier 1, which is capable of holding at least two paper web rolls, so that, if the machine runs out of paper from one roll, paper can be supplied, rapidly, from the other, while the empty roll is being replaced. The roll carrier 1 is constructed in the form of a pivotable frame 3, journalled in a bearing 2. The frame 3 is a double-arm lever, retaining at its ends two web rolls 4, 5. One of the rolls supplies webs to a utilization apparatus, typically a printing machine. In the illustration, paper is removed from the roll 5 in form of a web 14. The printing machine itself is not shown.

The respective rolls 4, 5 are located on cores or core stubs or mandrels, schematically shown at 6 and 7. Each one of the core or mandrels or center rolls is coupled to a brake 8, 9, respectively. The brakes 8, 9, preferably, are constructed as caliper or disk brakes 10, 11, 12, 13. Disk brakes 10 and 12 control the tension of the web 4; disk brakes 11 and 13, which can operate on the same disk as the calipers of the brakes 10 and 12, preferably, utilize brake pads of higher frictional coefficient than the brake pads used with the normal operating brakes 10, 12; alternatively, or in addition to the higher frictional coefficient, two brake pads 11, 13 can be associated with a single disk which has only one caliper pair of pads 10, 12 for normal operation associated therewith.

The web 14, the tension and unreeling of which is to be controlled, is guided over suitable deflection rollers and to a roller pair 15, 16. A jockey, compensator, dancing or looping roller 17 is located between the rollers 15, 16, and has the web 14 partly looped thereabout. The compensating roller 17 maintains the web 14 under tension. The position of the compensating roller 17 can be scanned by a deflection sensor 24, for example in form of a link 21 coupled to a potentiometer which provides electrical output signals representative of the position of the compensating roller 18 in the deflection path of the web 14. Control signals for web tension can thus be obtained by sensing the position of the compensating roller 17.

The tension in the web 14 is set by a pneumatic cylinder-piston arrangement 18 which permits movement of the compensating roller 17 in the direction of the double arrow 19. A tension set control **20*a* controls the application of controllable pressure fluid, typically compressed air, to the cylinder of the cylinder-piston arrangement 18 to position the compensating roller 17 at a predetermined location between the rollers 15, 16 and thus set the tension of the web 14 as it is pulled off roller 16 by the printing machine. If the compensating roller 17 should reach a limiting position, the sensing or deflection arm 21 will engage either an upper or a lower stop or abutment element 22, 23. If the web should tear, so that tension would be lost, the roller 17 will rapidly move towards the upper stop 22, and deflection sensor 24 will provide, accordingly, a "torn web" signal on line 25. A jam in supply of the web 14, for example on the reel 5, or in the intermediate path, will cause the roller 17 to move downwardly, and link 21 will engage the abutment 23, and deflection sensor 24 will provide a "web jam" signal. The sensor 24, thus, senses the respective angular position of the arm 21. The tension can be manually set by the tension set control 20*a*, so that the roller 17** will maintain an appropriate position for the desired tension.

Figure 2:
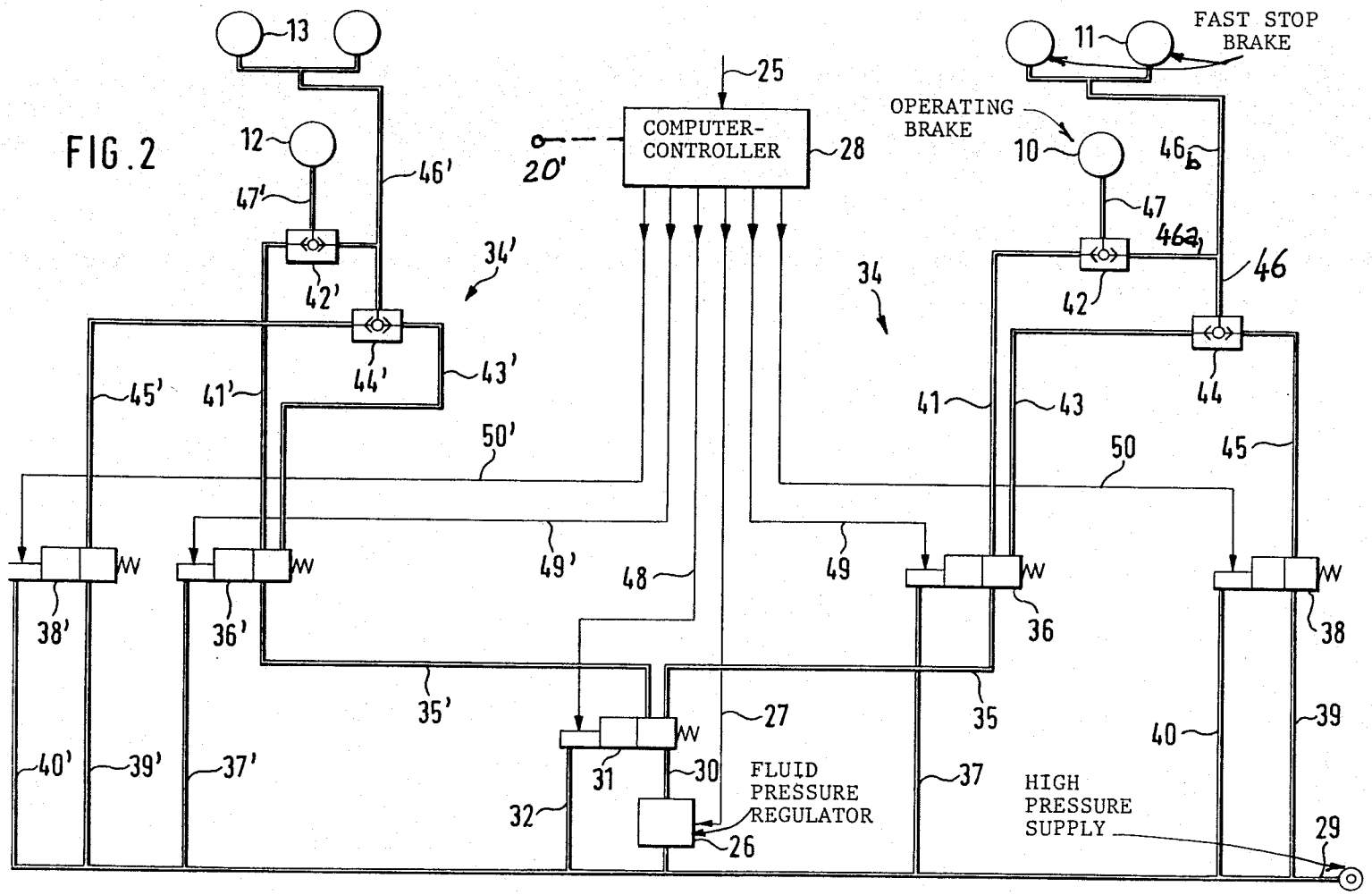

The signal from the deflection sensor 24 is connected via line 25 to an electrical computer-controller unit 28, FIG. 2. The computer-controller 28 can be any suitable microprocessor, or can be a control apparatus which merely receives limiting signals and provides corresponding control output signals at respective signal levels to the apparatus which controls the brakes.

The electrical signals from line 25 from the sensor 24, and, if desired, in connection with tension set values applied at line **20*a* and communicated from the controllable pressure fluid supply 20, for example, over line 20' to the computer controller, provide information to the computer controller which enable it to control the braking pressure to be applied by the operating brake 10** to the respective roll being unreeled.

Referring to FIG. 2: A high-pressure supply source, schematically shown at 29 and, for example, a source of compressed air, supplies the high fluid pressure to a fluid pressure regulator 26. Fluid pressure regulator 26 is controlled from the computer-controller 28 via line 27 to provide compressed air under controlled pressure level conditions on its output line 30. The fluid pressure regulator 26 may be a simple compressed air regulator, which is also known as an electro-pneumatic transducer or controller.

In accordance with a feature of the invention, the compressed air regulator 26 provides compressed air at pressure levels which correspond to the electrical signals applied at line 27. Preferably, minimum compressed-air pressure at the output 30 is at 0.5 bar. The output of the fluid pressure regulator can vary in accordance with the position of the compensating roller 17 as signalled to the deflection sensor 24, to provide more or less braking pressure on the operating brake 10 and thus maintain the roller 17 at a preset position, as determined by the tension setting input **20*a***.

The output 30 of the compressed air regulator 26 is connected to an input of a magnetic valve 31. Preferably, the respective magnetic valves of the system are servo valves, so that they require additional operating pressure. Operating pressure for the valves is provided from the high-pressure supply 29. For valve 31, a high-pressure supply is provided by line 32. The magnetic valve 31 has two outputs 35, 35'. In dependence on control of line 48, derived from the computer-controller 28, the valve 31 switches the output from the input line 30 to either one of the systems controlling the respective brakes 10, 11 and 12, 13 for the respective rolls 5 and 4. The rolls 5 and 4 have respective braking systems 34, 34' which are identical and have been given identical reference numeral one, with prime notations. Only the system 34 will be described in detail. Valve 31, thus, is provided to control switch-over of the system between the respective rolls 4 and 5.

Output line 35 of the system 34 controls the brakes 10, 11; output line 35', associated with the system 34', controls the brakes 12, 13 for the roll 4.

The compressed air line 35 is connected to a magnetic valve 36 which has two outputs 41 and 43. This valve, effectively, controls braking of the roll 5 in the system 34. Preferably, valve 35 also is a servo magnetic valve, receiving operating pressure from a high-pressure supply line 37 from the high-pressure supply 29. Output 41 of the magnetic valve 36 is connected to a pneumatic OR-gate valve 42. The second output 43 of valve 46 is connected preferably over a second OR-gate valve 44 to an output line 46. The output line 46 branches into a line **46*a* connected to a second input of the first OR-gate valve 42 and a second line 46*b* which is connected directly to the fast-stop brake or brakes 11 coupled to the roll 5**.

A servo magnetic valve 38 is connected via line 39 to the high-pressure supply 29. Valve 38 is controlled electrically via line 50 from the computer controller 28 and energized with high pressure fluid by high pressure line 40. The output at valve 38 is connected to the second OR-gate valve 44.

OPERATION

Depending on the control signals derived from the computer controller 28, either regulated compressed air line 41 or regulated compressed air line 43 will have compressed air applied thereto by suitable operation of the valve 36 under control of electrical signals from line 49 of the computer controller 28. Under normal operation, line 41 is the only line which carries compressed air. This pressure controlled compressed air is applied over the OR-gate valve 42 to the operating brake 10. Thus, upon any deviation of web tension, as sensed by the compensating roller 17 (FIG. 1) and signalled via line 25, the computer controller 28 can control the pressure level by controlling the regulator 26 via line 27. This results in fine rapidly regulated tension of the web 14 under ordinary operating conditions.

If the compensating roller 17 should deflect excessively, for example against one of the stop elements 22, or 23, an emergency situation is being signalled by the sensor 24 via line 25 to the computer controller 28 (FIG. 2). The computer controller 28 will then provide an output signal to the valve 36 via line 49 to change over the position of the valve 36 so that, then, compressed air under regulated pressure is applied to the output lie 43 and hence through the OR-gate valve 44 to line 46 and then, branched, to both the operating brake 10 and the fast-stop brake or brakes 11. Consequently, the brakes 10 and 11 will be operated together and under controlled pressure so that emergency stopping, but still under controlled condition, can be carried out. This substantially reduces the danger of tearing-through of a web or permits elimination of web tearing by appropriate setting of the abutments or stop elements 22, 23, for example in positions at which tension becomes excessively high, or excessively low, which can be determined, by experience, to cause trouble if such tension conditions persist. Thus, substantial trouble conditions can be anticipated and paper payout and the system stopped before further damage results.

Under higher emergency operation, for example upon loss of electrical signals and also upon intended change of rolls 5 or 4, or exchange of rolls for new rolls, line 45 will be pressurized directly with uncontrolled high-pressure fluid through line 38 via line 39. A signal is applied over line 50. This signal can be "fail-safe", for example the magnet valve 38 can be so constructed that it is blocked when a voltage is applied to the signal. Upon loss of voltage of the signal, air is automatically applied through the valve from line 39 to line 45 and then via the OR-gate valve 44 to both the operating brake 10 via line **46*a* and the first OR-gate valve 42 and to the fast-stop brake or brakes 11 via line 46*b*. This compressed air will not be at a controlled pressure level. However, even under such emergency conditions, for example loss of signal or loss of electrical power, rapid stopping and braking of the respective roll which supplies materials, in the example selected of roll 4**, is insured.

Electric lines 48, 49, 50 control the magnetic valves 31 36, 28 to provide control signals from the computer-controller 28. Similarly, electrical lines 49', 50' provide control signals to the valves 36', 38' of the system 34' for the roll 4.

To exchange rolls, the computer controller can be set to provide output signals over line 48 to the valve 31 to switch over valve 31 and, then, control the system 34'.

Various changes and modifications may be made within the scope of the inventive concept. For example, the tension setting control **20*a* can be combined as a control function in the computer-controller 28**.

We claim:

1. Web tension control and combined rapid-stop system, particularly for paper webs being delivered to a rotary web printing machine, said system having a roll support carrier (1, 2, 3) for supporting at least one roll (4, 5) on which the web (14) is wound;

a first brake forming an operating brake (10) secured to the support carrier for braking the at least one roll upon unwinding thereof;

a second brake forming a fast stop brake (11) secured to the support carrier and additionally braking the at least one roll for fast stopping condition;

a movably journaled tension or compensating roller (17) about which the web (14), unreeled from the at least one roll is looped;

a tension sensing means (21, 24) for sensing the position of the tension or compensating roller and for providing a tension signal;

a computer-controller unit (28) receiving the tension signal, and a source of fluid pressure (29), and comprising an electrically controllable fluid pressure regulator (26) receiving pressurized fluid from said source (29) connected to and controlled by the computer-controller unit (28) and providing fluid pressure output at a regulated pressure level, as commanded by said computer-controller unit (28);

an electrically controlled magnetic valve (36) having two pressure fluid outputs (41, 43) connected to and controlled by said computer-controller unit (28);

means (35) for supplying pressure fluid from said fluid pressure regulator (26) to said valve (36);

a fluid disjunctive or OR-gate valve (42) having a fluid output connection (47) connected to and controlling the operating brake (10);

an operating brake fluid connecting (41) from a first output of the electrically controllable magnetic valve (36) to a first input of the fluid disjunctive or OR-gate valve (42);

a stop brake fluid pressure connection (43, 44, 46, **46*b*) from a second output of the electrically controllable magnetic valve (36) to the fast-stop brake (11); and a further branch connection (46*a*) from said second output of the electrically controlled magnetic valve (36) to a second input of the fluid disjunctive or OR-gate valve (42), to provide (a) for normal operation, controlled fluid pressure to the operating brake (10) via the first input of the OR-gate valve (42), and (b) under fast-stop conditions or emergency conditions, controlled fluid pressure to the fast-stop brake (11) via the fast-stop brake fluid pressure connection and further to the operating brake (10) via said further branch connection (46, 46*a*) to the OR-gate valve (42**).

2. The system of claim 1, wherein the fast-stop brake (11) has a higher brake friction coefficient than the operating brake (10).

3. The system of claim 2, wherein the source of fluid pressure (29) comprises compressed air;

the fluid pressure regulator (26) comprises an electro-pneumatic transducer;

and wherein said electrically controllable magnetic valves (36, 38) and said OR-gate valve (42) comprise pneumatic valves.

4. The system of claim 1, wherein the operating brake (10) is a caliper-disk brake;

and wherein the fast-stop brake (11) comprises a caliper disk brake transferring higher braking effort to the disk than the operating brake (10).

5. The system of claim 4, wherein the fast-stop brake (11) comprises a plurality of caliper jaws.

6. The system of claim 1, wherein said support carrier supports at least two rolls (4, 5) for selectively supplying the web (14);

each support roll carrier having an operating brake (10), a fast-stop brake (11), a tension or compensating roller (17), tension sensing means (21, 24), an electrically controlled magnetic valve (36), pressure fluid supply means (35), a fluid disjunctive or OR-gate valve (42), a fluid pressure connection (41), a stop brake fluid pressure connection (43, 44, 46, 46*b*) and a further branch connection (46, 46*a*) associated therewith;

and wherein a switch-over magnetically controlled valve (31) is provided, connected to and controlled by said computer-controller unit for, selectively, supplying regulated fluid from said fluid pressure regulator (26) to a selected one of said electrically controlled magnetic valves (36, 36').

7. The system of claim 6, wherein, for each of the at least two rolls, an additional magnetic valve (38') and an additional fluid OR-gate valve (44') is provided;

the additional fluid disjunctive or OR-gate valve (44') having an input and its output connected in the stop-brake fluid pressure connection (43', 46'), said additional fluid disjunctive or OR-gate valve (44') having a second input (45') connected to said source of fluid pressure (29); and the additional electromagnetic valve (38) being interposed between the source of fluid pressure (29) and said second input of the additional fluid pressure disjunctive or OR-gate valve (42'), connected to and controlled by said computer-controller (28) for supplying unregulated fluid pressure from said source of fluid pressure, under command of said computer-controller under emergency or roll change conditions to the further branch connection (46*a*) and hence to the operating brake (10) and to the fast-stop brake.

8. The system of claim 7, wherein the source of fluid pressure (29) comprises compressed air;

the fluid pressure regulator (26) comprises an electro-pneumatic transducer;

and wherein said electrically controllable magnetic valves (36, 38) and said OR-gate valve (42) comprise pneumatic valves.

9. The system of claim 6, wherein the source of fluid pressure (29) comprises compressed air;

the fluid pressure regulator (26) comprises an electro-pneumatic transducer;

and wherein said electrically controllable magnetic valves (36, 38) and said OR-gate valve (42) comprise pneumatic valves.

10. The system of claim 1, further including an additional fluid disjunctive or OR-gate valve (44) having an input and its output connected in the stop-brake fluid pressure connection (43, 46), said additional fluid disjunctive or OR-gate valve (44) having a second input (45) connected to said source of fluid pressure (29);

and an additional electromagnetic valve (38) interposed between the source of fluid pressure (29) and said second input of the additional fluid pressure disjunctive or OR-gate valve (42), connected to and controlled by said computer-controller (28) for supplying unregulated fluid pressure from said source of fluid pressure, under command of said computer-controller under commanded stop conditions to the further branch connection (46*a*) and hence to the operating brake (10) and to the fast-stop brake.

11. The system of claim 10, wherein the source of fluid pressure (29) comprises compressed air;

the fluid pressure regulator (26) comprises an electro-pneumatic transducer;

and wherein said electrically controllable magnetic valves (36, 38) and said OR-gate valve (42) comprise pneumatic valves.

12. The system of claim 1, wherein the electrically controllable magnetic valves (31, 36, 38) are servo valves.

13. The system of claim 1, wherein the source of fluid pressure (29) comprises compressed air;

the fluid pressure regulator (26) comprises an electro-pneumatic transducer;

and wherein said electrically controllable magnetic valves (36, 38) and said OR-gate valve (42) comprise pneumatic valves.

14. The system of claim 13, wherein the pressure level of the output of the electro-pneumatic transducer (26) is at a pressure level of at least 0.5 bar.

* * * * *